US010753596B1

(12) United States Patent
Lopez-Martinez et al.

(10) Patent No.: US 10,753,596 B1
(45) Date of Patent: Aug. 25, 2020

(54) APPARATUS AND METHOD FOR MAKING ENCAPSULATED LINEAR LIGHTING OF ARBITRARY LENGTH

(71) Applicant: Elemental LED, Inc., Reno, NV (US)

(72) Inventors: Gilberto Lopez-Martinez, Reno, NV (US); Daniel South, Dayton, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 16/797,261

(22) Filed: Feb. 21, 2020

(51) Int. Cl.

| | |
|---|---|
| ***F21V 31/04*** | (2006.01) |
| ***F21S 4/20*** | (2016.01) |
| *F21Y 103/10* | (2016.01) |
| *F21Y 115/10* | (2016.01) |

(52) U.S. Cl.
CPC ..... *F21V 31/04* (2013.01); *F21S 4/20* (2016.01); *F21Y 2103/10* (2016.08); *F21Y 2115/10* (2016.08)

(58) Field of Classification Search
CPC .... F21V 31/04; F21S 4/20; F21S 4/24; H05K 3/284
See application file for complete search history.

(56) References Cited

U.S. PATENT DOCUMENTS 5,923,536 A * 7/1999 Lumbard ..... H05K 3/284 361/752
9,620,889 B1 4/2017 Buck et al.
2008/0253140 A1 10/2008 Fleischmann et al.
2010/0277914 A1* 11/2010 Bachl ..... F21V 29/75 362/249.01
2014/0198480 A1 7/2014 Dai et al.
2018/0031190 A1 2/2018 Nicolai et al.
2018/0306413 A1* 10/2018 Tremaine ..... F21V 31/04

OTHER PUBLICATIONS

Second Declaration of Gilberto Uriel Lóopez-Martínez and Daniel I South, executed Apr. 28-29, 2020.
Declaration of Gilberto Uriel López-Martínez and Daniel I South, executed Apr. 17, 2020.

* cited by examiner

*Primary Examiner* — Isiaka O Akanbi
*Assistant Examiner* — Nathaniel J Lee
(74) *Attorney, Agent, or Firm* — United IP Counselors, LLC

(57) ABSTRACT

Methods for making encapsulated linear lighting are disclosed. In these methods, linear lighting is placed in a polymeric channel, and the channel is filled with a resin in order to encapsulate the linear lighting. In order to prevent leaks, the channel is dammed at both ends of the linear lighting with stoppers. The channel has interior engaging features, such as grooves or ridges, that engage with complementary features on the sidewalls of the stoppers to form a seal between the channel and the stoppers. The resin within the channel is caused or allowed to cure, and once cured, the stoppers are removed from the channel.

19 Claims, 11 Drawing Sheets

APPARATUS AND METHOD FOR MAKING ENCAPSULATED LINEAR LIGHTING OF ARBITRARY LENGTH

TECHNICAL FIELD

The invention relates to encapsulated linear lighting, and to methods for making encapsulated linear lighting.

BACKGROUND

Linear lighting is a particular class of solid-state lighting that uses light-emitting diodes (LED). In this type of lighting, a long, narrow printed circuit board (PCB) is populated with LED light engines, usually spaced at a regular pitch or spacing. The PCB may be either rigid or flexible, and other circuit components may be included on the PCB, if necessary. Depending on the type of LED light engine or engines that are used, the linear lighting may emit a single color, or may be capable of emitting multiple colors.

In combination with an appropriate power supply or driver, linear lighting is considered to be a luminaire in its own right, and it is also used as a raw material for the production of more complex luminaires, such as light-guide panels. In practice, strips of PCB may be joined together in the manufacturing process to produce linear lighting of essentially any length. Spools of linear lighting 30 meters (98 ft) in length are common, and spools of linear lighting 100 meters (328 ft) in length are commercially available.

Fundamentally, linear lighting is a microelectronic circuit. That circuit is susceptible to physical damage. Therefore, manufacturers have sought ways to make linear lighting more robust and more resistant to damage from physical impact and ingress of water and other debris. One of the most popular ways to protect linear lighting is to encapsulate it—i.e., to encase it—within a polymer resin. Two popular types of polymer resins used to encapsulate linear lighting are polyurethanes and silicones. Depending on the application and the polymer, the encapsulation itself may be rigid or flexible.

In a typical process, a polymeric channel is first manufactured, usually by casting it from a liquid resin or extruding it. The linear lighting is installed in that channel, and the channel is then filled with resin to complete the encapsulation process. The polymer resin typically has a low viscosity when it is first dispensed, and so the channel in which the linear lighting is placed must be capped or dammed in order to prevent the polymer resin from leaking out. This is easier if the encapsulated linear lighting is made only to specific lengths, in which case dammed channels of those specific lengths can be made. If linear lighting of arbitrary length is needed, the typical solution is to glue a cast or injection-molded endcap into the channel at an appropriate point. While this is effective, it is also time-consuming, and because it uses adhesive and a cap that may be made of a different material, it may introduce undesirable compounds into the encapsulation. Better ways of preventing leaks in linear lighting encapsulation processes would be helpful.

BRIEF SUMMARY

Aspects of the invention relate to methods for making encapsulated linear lighting. In these methods, linear lighting is placed in a polymeric channel, and the channel is filled with a resin in order to encapsulate the linear lighting. In order to prevent leaks, the channel is dammed at both ends of the linear lighting with stoppers. The channel has interior engaging features, such as grooves or ridges, that engage with complementary features on the sidewalls of the stoppers to form a seal between the channel and the stoppers. The resin within the channel is caused or allowed to cure, and once cured, the stoppers are removed from the channel.

Other aspects of the invention relate to the stoppers themselves. The stoppers themselves are typically made of a material that will not bind to the channel or the resin that is used in the encapsulation. If the linear lighting is connected to a power cord, the stopper at the cord end of the linear lighting would typically be provided with an opening to allow the cord to pass. In some embodiments, a vertical slit may be provided from the opening to the top or bottom of the stopper in order to allow the stopper to be seated over the cord.

Yet other aspects of the invention relate to production methods in which multiple strips of encapsulated linear lighting are manufactured in the same channel using multiple stoppers. In these processes, multiple lengths of linear lighting are installed in the same channel, and stoppers are placed proximate to the beginning and end of each strip of linear lighting. The volume between pairs of stoppers is filled with resin, the resin is caused or allowed to cure, and the stoppers are removed from the channels.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
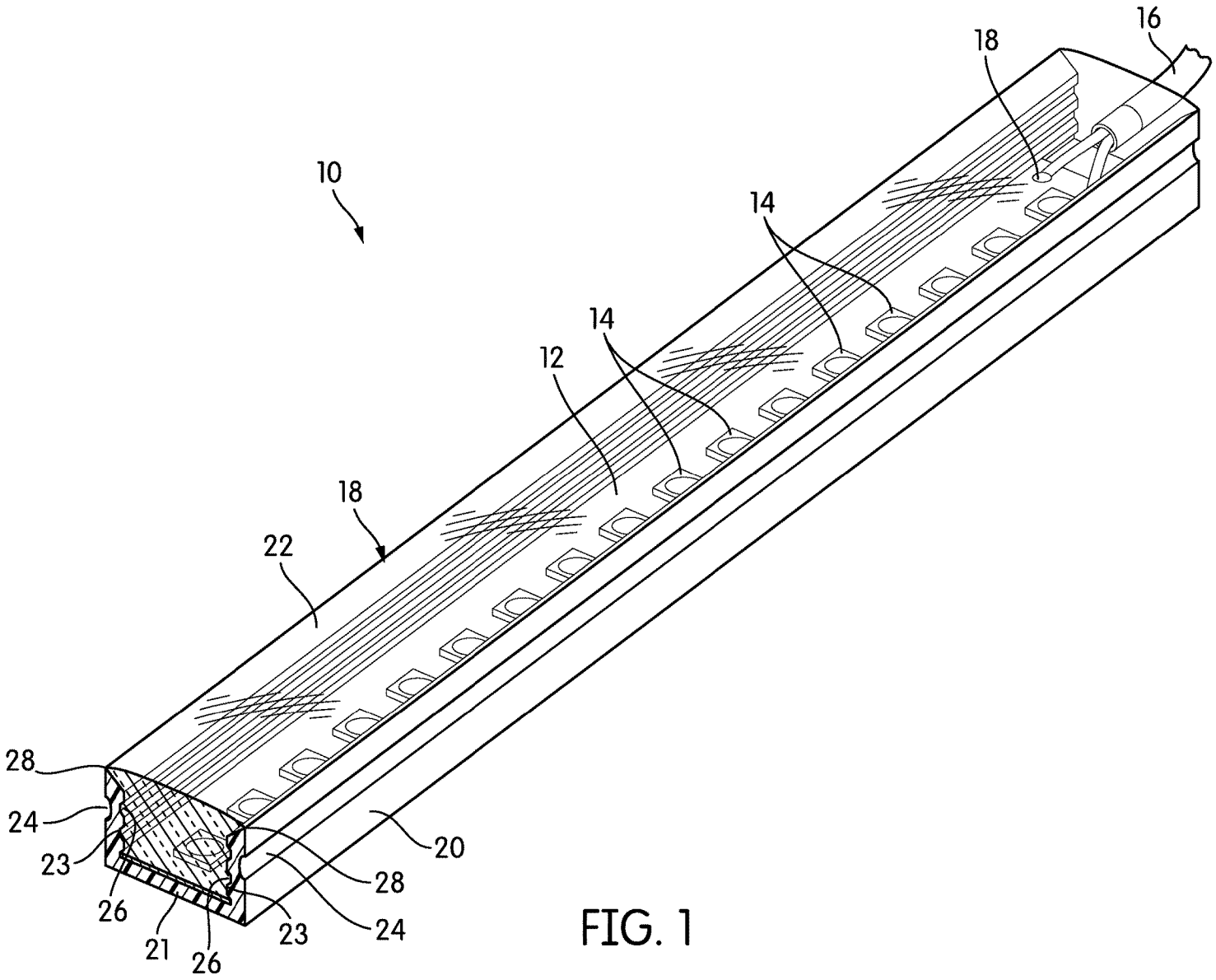
FIG. 1 is a perspective view of a strip of encapsulated linear lighting according to one embodiment of the invention.

FIG. 1 is a perspective view of a strip of encapsulated linear lighting, generally indicated at 10, according to one embodiment of the invention. At the core of the strip of encapsulated linear lighting 10 lies a long, narrow printed circuit board 12 (PCB), on which are disposed a plurality of LED light engines 14.

As the term is used here, "light engine" refers to an element in which one or more light-emitting diodes (LEDs) are packaged, along with wires and other structures, such as electrical contacts, that are needed to connect the light engine to a PCB. LED light engines may emit a single color of light, or they may include red-green-blue (RGBs) that, together, are capable of emitting a variety of different colors depending on the input voltages. If the light engine is intended to emit "white" light, it may be a so-called "blue pump" light engine in which a light engine containing one or more blue-emitting LEDs (e.g., InGaN LEDs) is covered with a phosphor, a chemical compound that absorbs the emitted blue light and re-emits either a broader or a different spectrum of wavelengths. The particular type of LED light engine is not critical to the invention. In the illustrated embodiment, the light engines are surface-mount devices (SMDs) soldered to the PCB 12, although other types of light engines may be used.

To make a functional strip of encapsulated linear lighting 10, other components may be mounted on the PCB 12. In a typical power circuit for LED light engines, the current flow to the light engines is controlled. This may be done in the power supply, or it may be done by adding components directly to the PCB 12 to manage current flow. Linear lighting that is designed to control the current flow using circuit elements disposed on the PCB 12 is often referred to as "constant voltage" linear lighting. Linear lighting that requires the power supply to control the current flow is often referred to as "constant current" linear lighting. Constant-current linear lighting is often used when the length of the linear lighting is known in advance; constant-voltage linear lighting is more versatile and more easily used in situations where the length, and resulting current draw, is unknown or is likely to vary from one installation to the next.

The encapsulated linear lighting 10 may be either constant voltage or constant current. If the encapsulated linear lighting 10 is constant voltage, passive circuit elements like resistors are suitable current control components, although active circuit elements, like current control integrated circuits, may also be used.

Generally speaking, linear lighting may accept either high voltage or low voltage. While the definitions of "high voltage" and "low voltage" may vary depending on the authority one consults, for purposes of this description, "high voltage" should be construed to refer to any voltage over about 50V. High voltage typically brings with it certain enhanced safety and regulatory requirements. The encapsulated linear lighting 10 may be either high-voltage or low-voltage, although certain portions of this description may relate specifically to low-voltage linear lighting.

At one end, a jacketed power cable brings power to the PCB 12, and is usually connected to the PCB 12 by soldering to solder pads 18 that are provided on the PCB 12. However, various forms of connectors and terminal blocks may also be used.

The PCB 12 and the power cable 16 are fully encapsulated in the illustrated embodiment, meaning that a covering, generally indicated at 18, surrounds these components. The covering 18 provides a high degree of ingress protection, and depending on the polymer, may confer an ingress protection rating of IP68 or higher. While the covering may be completely solid with no gaps, in practice, there may be gaps and other features within the covering 18. For example, the covering 18 may include an air gap over the PCB 12 or other such features in order to modify or control the emission of light out of the encapsulated linear lighting 10.

The covering 18 may be a silicone polymer, a polyurethane polymer, or some other type of polymer system. Irrespective of the particular chemistry of the polymer system, the following discussion assumes that the covering 18 is comprised of a thermoset polymer system that is supplied in two or more liquid parts and is mixed and dispensed by a dispensing system. The resulting polymer resin, typically low-viscosity when dispensed, cures to a solid, either at room temperature or at elevated temperatures. For example, the DEMAK CV SMART line of encapsulation machines (Demak Group, Torino, Italy) dispense mixed, two-part polyurethane resins, and in many cases, include ovens to cure the dispensed resins at elevated temperatures. Some machines of this type store the resin components under vacuum, so that no degassing is needed after mixing. However, a dispensing machine is not always necessary; rather, especially for shorter lengths of encapsulated linear lighting 10, it is perfectly possible to mix, dispense, and degas the mixture using manual techniques and a conventional degassing vacuum chamber.

It should be understood that the covering 18 may be either rigid or flexible. The PCB 12 itself may be either flexible or rigid as well. As those of skill in the art will understand, definitions of the terms "flexible" and "rigid" may be complex, contextual, and variable. For purposes of this description, it is sufficient to say that the solid covering 18 may have a range of possible durometer hardnesses, elastic moduli, and other mechanical properties. As one example of "flexible" and "rigid," the SEPUR 540 RT/DK 100 HV two-part polyurethane system (Special Engines S.r.l., Torino, Italy) has a durometer hardness of 68-75 Shore A at room temperature according to the ASTM D 2240 test standard, and may be considered flexible for these purposes, while the similar SEPUR 540 RT/DK 180 HV two-part polyurethane system has a durometer hardness of 75-78 Shore A, and may be considered rigid for these purposes. Ultimately, anything that can provide a degree of protection for the PCB 12 may be used.

As was described briefly above in the background, and as will be described in much greater detail below, to encapsulate linear lighting, the encapsulation is usually made in several parts. A base or channel is created first, the PCB is installed on the base or in the channel, and then the base or channel is filled or overcoated to create the final product. Here, the covering 18 has a channel 20. The channel 20 is manufactured first, the PCB 12 is installed in the channel 20, and then fill 22 is dispensed or deposited into the channel 20 to encapsulate the PCB 12.

The channel 20 has a bottom 21 and sidewalls 23 that arise and extend upwardly from the bottom 21. In the illustrated embodiment, the PCB 12 is installed along the interior bottom 21, although in other embodiments, the PCB 12 may be installed along either sidewall 23. The channel 20 may have external features that allow the strip of encapsulated linear lighting 10 to be used with mounting clips, channels, and other accessories that allow for mounting. In the illustrated embodiment, the channel 20 has a rounded groove 24 that runs the length of the channel 20 along the upper portion of each sidewall 23. These rounded grooves 24 allow for the use of a mounting clip.

Each sidewall 23 has a set of ridges 26 on the interior side. These ridges 26 extend the entire length of each sidewall 23 and at least a substantial portion of the height of each sidewall 23. Their purpose will be described in more detail below. However, as seen in FIG. 1, the fill 22 fills the channel 20 completely and conforms to the ridges 26. The sidewalls have sharp upper edges 28 that, in combination with surface tension, allow the fill 22 to assume a slightly convex, domed appearance, depending on the level to which the channel 20 is filled.

The channel 20 and the fill 22 would typically be made of the same material, or at least, the same type of material. For example, the channel 20 and the fill 22 may be made with the same two-part polyurethane or silicone resin system. In some cases, the channel 20 may be made of the same polymer or polymer system as the fill 22, but could have colorants or other additives relative to the fill 22. For example, the channel 20 could be colored white for reflectivity, or could include a ceramic, metallic, or other filler for heat conductivity. As may be apparent from the description above, if the channel 20 and the fill 22 are made from the same polymer with the same additives, their appearance would typically be the same, and it may be difficult or impossible to distinguish between the channel 20 and the fill 22 in the finished product.

The channel 20 may be made by extrusion. Even if the fill 22 is to be a two-part system that is deposited into the channel 20, extrusion of the channel 20 is possible. In that case, the channel 20 would typically be made with a polymer that is similar to the two-part polymeric system used for the fill 22. For example, if a two-part thermoset polyurethane is used for the fill 22, a thermoplastic polyurethane may be used for the channel 20.

Although much of this description will assume that the channel 20 is polymeric, the channel 20 could be made of some other material, so long as the fill 22 will bond to it. For example, the channel 20 could be made of a cast or extruded metal, such as aluminum.

The remainder of this description will assume that the channel 20 is made by casting a two-part liquid polymer system into a mold. In a casting process of this type, a master tool is created in the shape of the channel 20. That master tool is a positive—it has the shape of the channel 20 itself. The master tool used to create a mold or molds, which are essentially the negative of the desired shape. Liquid polymer resin is poured into the mold to create the channel 20.

Figure 2:
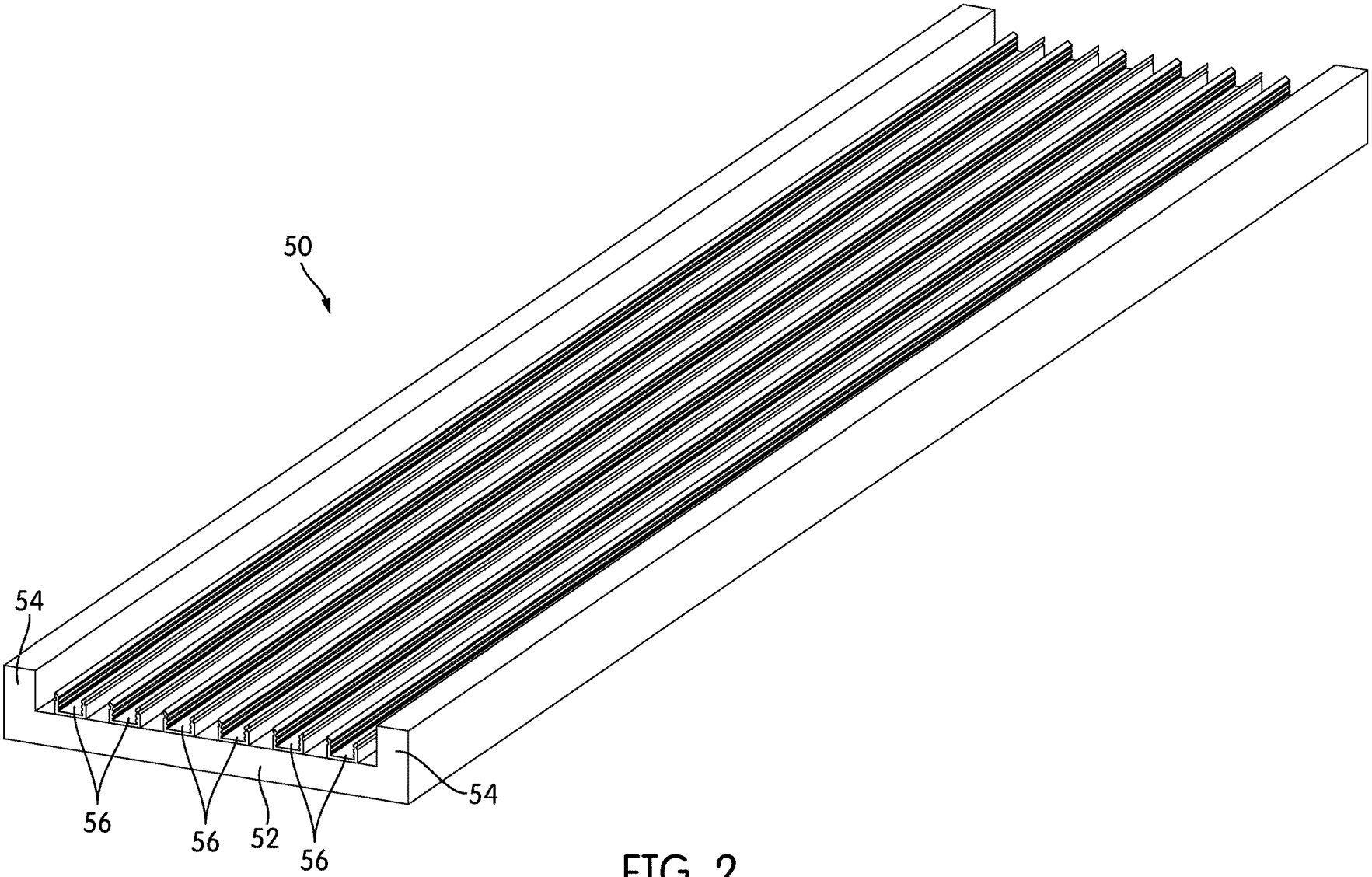
FIG. 2 is a perspective view of a master tool for making channel for the encapsulated linear lighting of FIG. 1.

FIG. 2 is a perspective view of a master tool, generally indicated at 50, for making the channel 20. The tool 50 has a base 52 and two squat, relatively thick sidewalls 54. The base 52 is flat and planar on both sides. Arising from the base are six tracks 56 that have the precise shape and features of the channel 20. Multiple tracks 56 allow the channel 20 to be made en masse, with several lengths made in parallel to one another. Although not shown in FIG. 2, the master tool usually has engaging structure that allows it either to be connected to other master tools 50 to create longer lengths, or to be capped at its ends. To create a mold for making channel, the ends of the master tool 50 are capped and a mold polymer, usually silicone if polyurethane is the channel material, is poured into the master tool 50 up to the tops of the sidewalls 54.

Figure 3:
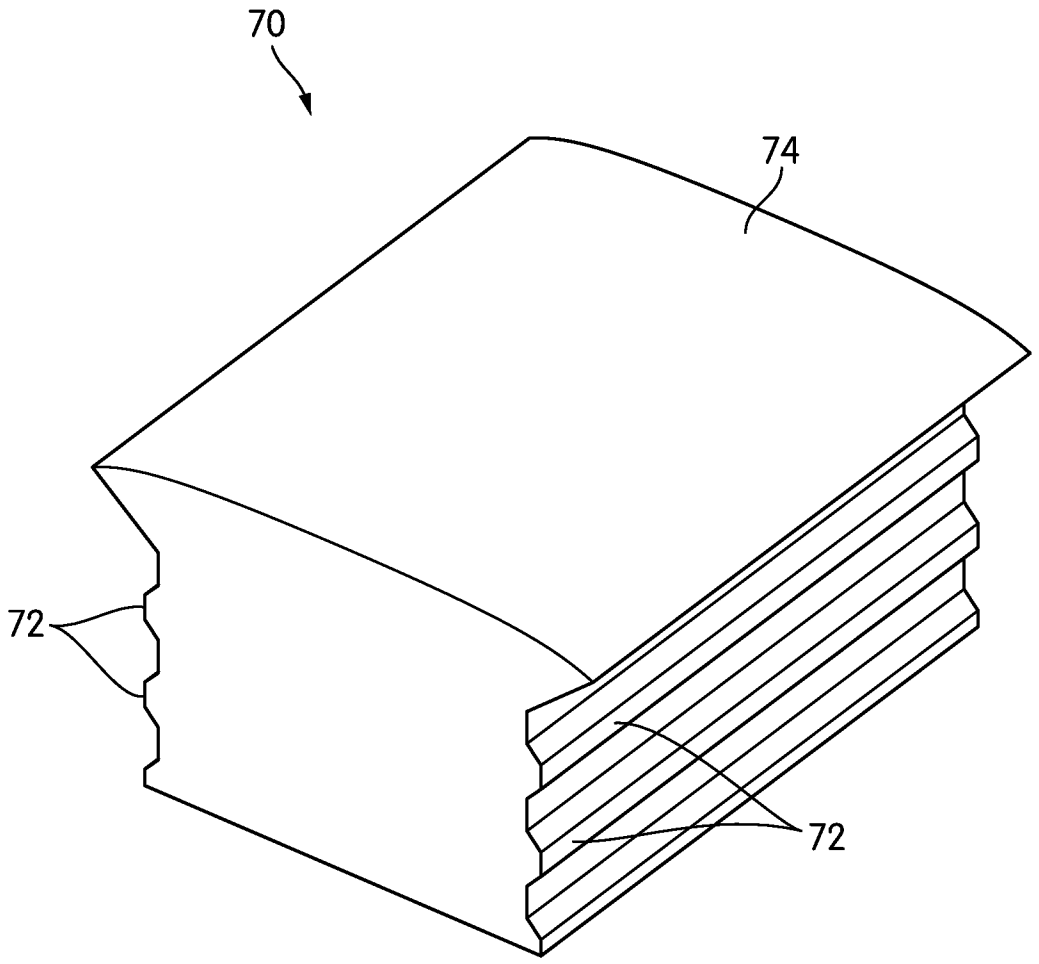
FIG. 3 is a perspective view of a stopper for making the encapsulated linear lighting of FIG. 1.

The master tool 50 of the illustrated embodiment may also be used to create a removable dam or stopper that, in turn, is used to make encapsulated linear lighting 10 of arbitrary lengths. More particularly, if mold polymer, such as silicone, is poured only into the channels 56 of the master tool 50, the result is a length of cured mold polymer that has a shape that is the complement of the shape of the inside of the channel 20. FIG. 3 is a perspective view of one example of a dam or stopper 70. Typically, a long length of mold polymer cured in the channels 56 of the master tool 50 is cut into convenient lengths to form the stopper 70. For example, a length of about 1 inch (2.5 cm) may be suitable, although longer or shorter lengths may be used.

The stopper 70 has the same shape as the fill 22 within the channel 20 of a finished encapsulated strip of linear lighting 10. It has a generally flat bottom and generally vertical sidewalls. The stopper 70 also has sets of ridges 72 on its generally vertical sidewalls that are the complement of the ridges 26 on the interior sidewalls 23 of the channel 20. The ridges 72 give the sides of the stopper 70 an undulating appearance. The stopper 70 of FIG. 3 also has a domed top 74 that has the generally the same shape and extent as the fill 22. Stoppers 70 will often be flexible, especially if made of a polymer like silicone, although they need not be in all embodiments. The material of which the stopper 70 is made should not bond with the channel 20 or with the material that serves as the fill 22 of the encapsulated linear lighting 10.

While the above describes the creation of stoppers 70 directly from a master tool 50, in some cases, stoppers 70 may be made by molding them using a channel 20 as the mold. The channel 20 in which the stoppers 70 are made may be the same channel 20 in which the stoppers 70 are intended to be used. This may provide the best fit and interengagement between the stopper 70 and its channel 20. If a stopper 70 is made in the channel 20 in which it is to be used, it is helpful if care is taken to cure the stopper material completely, so that there are no remnants that might create issues with curing the fill 22 later in the process.

Figure 4:
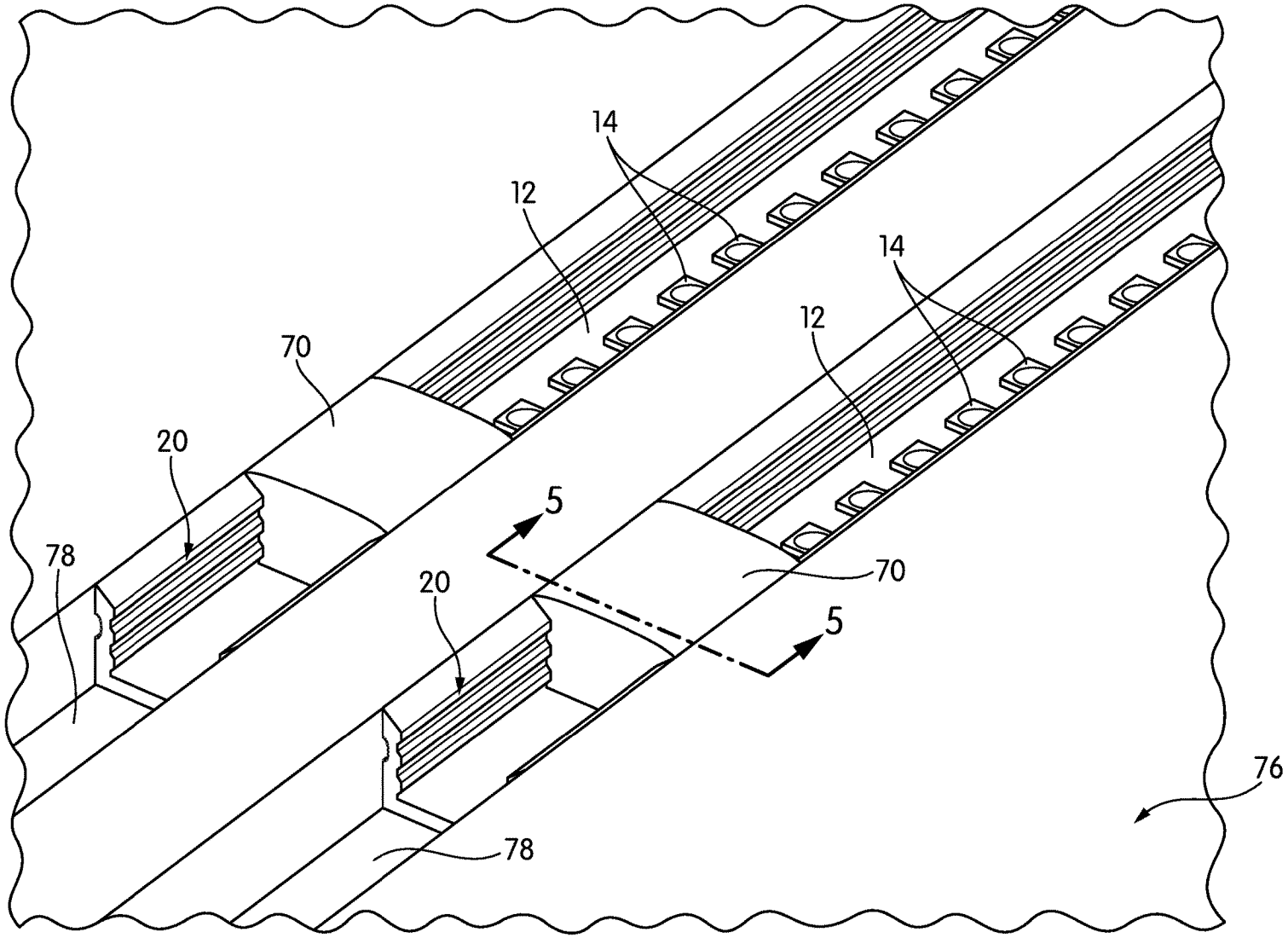
FIG. 4 is a perspective view of a channel set in a carrier with linear lighting PCB for encapsulation, illustrating the use of the stopper of FIG. 3.

FIG. 4 is a perspective view illustrating the use of stoppers 70. In the view of FIG. 4, two channels 20 are prepared for the deposition of the channel fill 22, and a stopper 70 is positioned in each channel 20. More particularly, FIG. 4 illustrates a carrier 76. For convenience, the carrier 76 is typically made of the same polymer as a process mold would be, e.g., silicone if polyurethane is the material of the channel 20 and the fill 22. However, as a form of positioning structure or jig, the carrier 76 may be made of essentially any material, although it is helpful if the fill 22 will not bond with the carrier 76 or can be easily removed from it.

The carrier 76 has one or more slots 78 that have basic dimensions just larger than the exterior dimensions of the channel 20. The slots 78 support the channel 20 during the process of filling it, e.g., preventing the sidewalls 23 of the channel 20 from bowing outwardly or buckling as they are filled. In essence, as an external support, the carrier 76 makes it possible for the channel 20 to be made of a very flexible material without that flexible material becoming a problem during manufacturing. Even if the channel 20 is made of a metal, a carrier 76, or a similar positioning structure, may still be useful in positioning the channel 20 for filling and in preventing tipping.

In the illustrated embodiment, each slot 78 has a rectilinear shape; it accommodates the channels 20 but does not complement or conform to their shapes. In other embodiments, the slots 78 could conform to the channel shape.

As shown in FIG. 4, each channel 20 is longer than the PCB 12 that is placed within it. In order to avoid gaps at the end of the encapsulation, wasted material, and other problems, stoppers 70 are placed within the channel 20 immediately adjacent to the ends of the PCBs 12. The stoppers 70 may be placed, e.g., 3-5 mm away from the ends of the PCB 12 in order to ensure that the fill 22 will completely encapsulate the end of the PCB 12. However, beyond that consideration, the stoppers 70 are placed as close as possible to the ends of the PCB 12.

Figure 5:
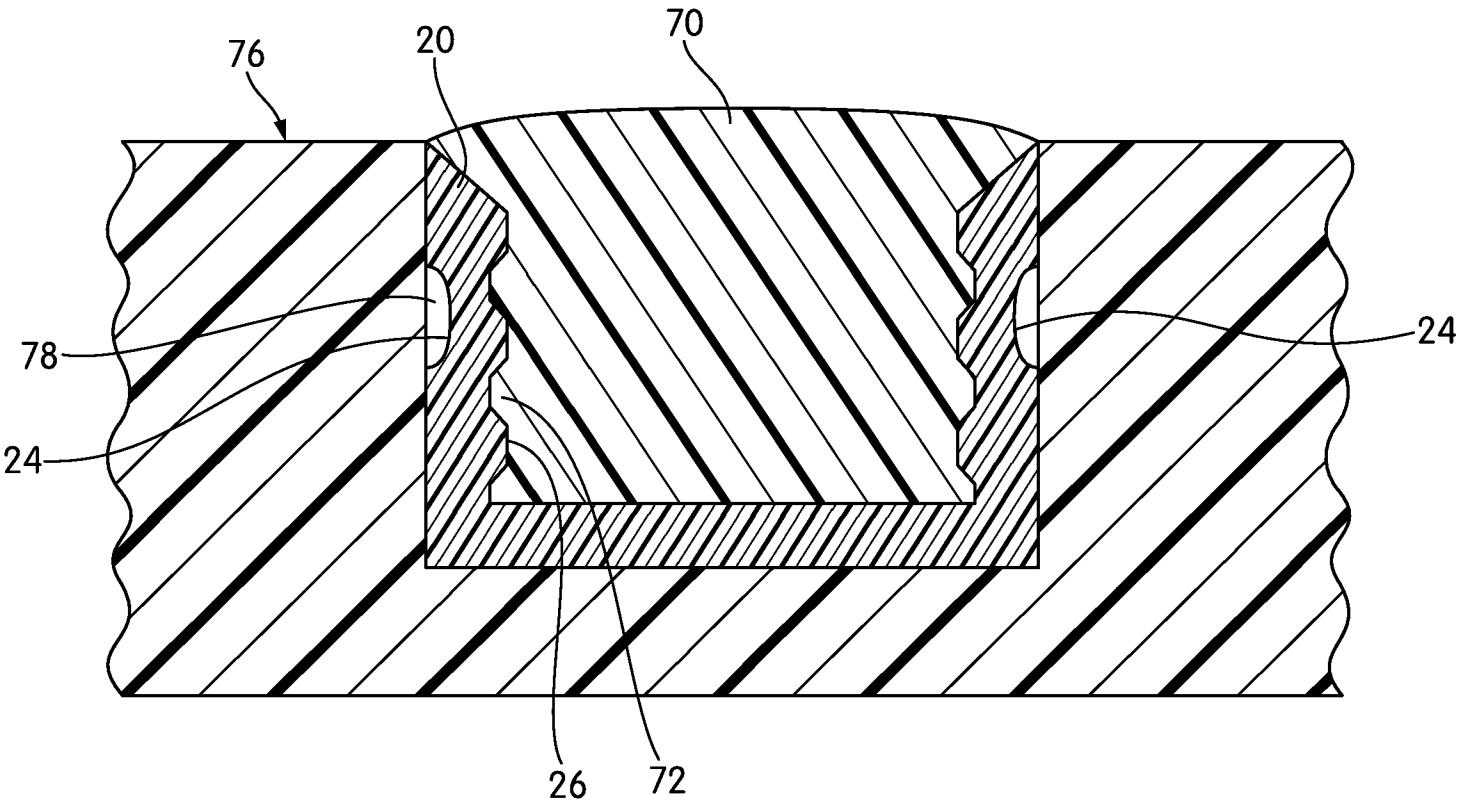
FIG. 5 is a cross-sectional view taken through Line 5-5 of FIG. 4, illustrating the engagement of the stopper and the channel.

FIG. 5 is a cross-sectional view taken through Line 5-5 of FIG. 4, showing the engagement of the stopper 70. The channel 20 rests within a slot 78 in the carrier 76. The ridges 26 of the channel 20 and the ridges 72 of the stopper 70 are a complement to one another and thus, a seal is formed between the channel 20 and the stopper 70.

Figure 6:
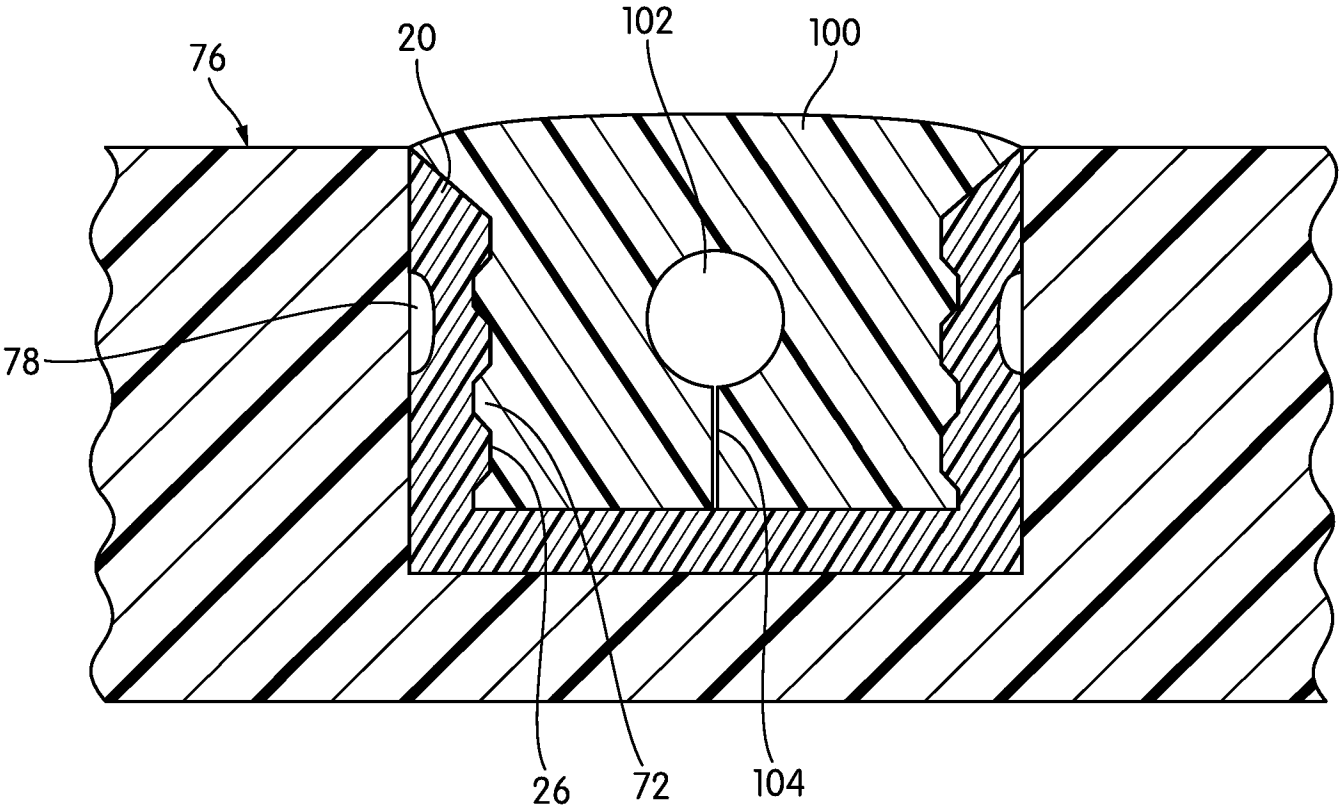
FIG. 6 is a cross-sectional view similar to the view of FIG. 5, illustrating a stopper with an opening for an electrical cord.

As those of skill in the art will appreciate, in order for a successful liquid deposition process to occur, both sides of the channel 20 should be dammed. FIG. 6 is a cross-sectional view similar to the view of FIG. 5 that illustrates a stopper 100 suitable for damming the cord-end of the channel 20. The stopper 100 has the same shape as the stopper 70, including side ridges 72 that are the complement of the ridges 26 of the interior sidewalls 23 of the channel 20. However, the stopper 100 also includes an opening 102 that is sized for the power cable 16 and a slit 104 that runs from the opening down to the bottom of the stopper 100, which allows the stopper 100 to be placed over the power cable 16. The opening 102 is sized for the particular power cable 16 and may be, e.g., punched or drilled in a cured stopper 70 to make a stopper 100 suitable for the cord-end of the channel 20. The slit 104 may similarly be cut with a razor. In some embodiments, a slit 104 may not be present, and the power cable 16 may simply be fed through the opening 102, but that may not be practical in all cases.

While drilling and punching may be used to create a stopper 100, those processes may not produce a stopper 100 with an opening 102 in a precise or repeatable location. For that reason, alternative processes may be used to mold or cast the stopper 100 with the opening.

Figure 7:
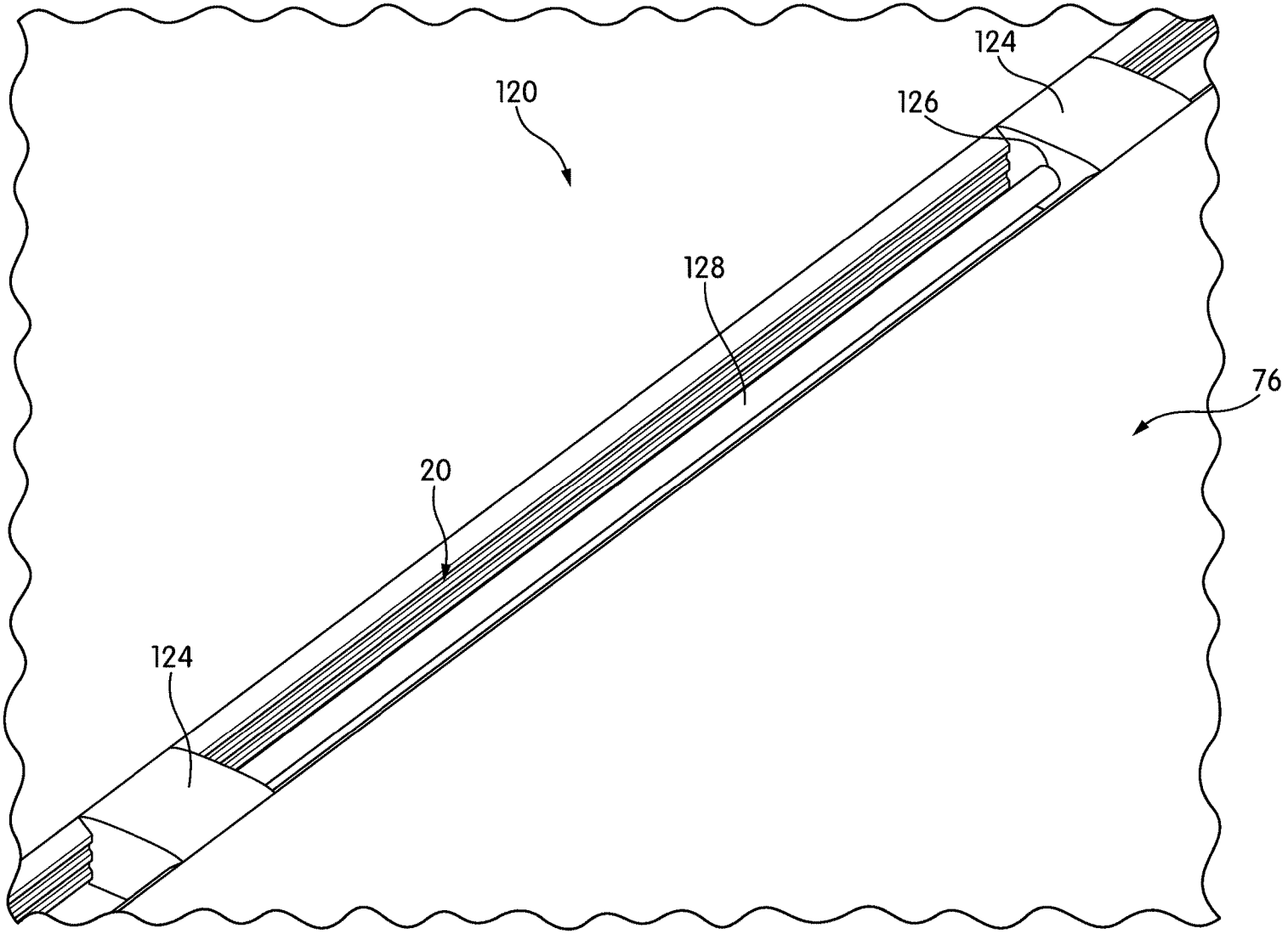
FIG. 7 is a sectional side elevational view of a tool for making the stopper of FIG. 6.

FIG. 7 is a perspective view illustrating a tool, generally indicated at 120, used to mold or cast a stopper 100 with an opening 102. The sidewalls 122 of the tool 120 have the shape of a channel 20, and may be either a channel 20, usually supported in a carrier 76, or a master tool 50. An end support 124 is present at each end of the tool 120. The end support 124 is a fabricated piece, made by, e.g., machining or 3D printing, that fits within the tool 120 and has an opening 126 aligned with the desired position of the openings 102 in the stoppers 100. The openings 126 support a rod 128 that is the desired diameter of the openings 102. (The openings 102 should be the same size as or just larger than the cable 16.) Material is poured into the tool 120 and cured to form a length of cured material that can be cut into stoppers 100. Because the rod 128 is supported within the tool 120 at an appropriate position, the stoppers 100 created using this tool 120 will have the opening 102 in the desired location without any additional punching, drilling, or other forming steps.

The stoppers 70, 100 may differ from one another in length. A stopper 70 used at the free end of a channel 20, as shown in FIG. 4, may be shorter than the stopper 100 used at the cord-end of the channel 20. For example, the stopper 100 may be 1 inch (2.54 cm) long, while the stopper 70 may be 0.5 inches (1.25 cm). The longer length of the stopper 100 provides for better strain relief and fixation for the cord 16.

Figure 8:
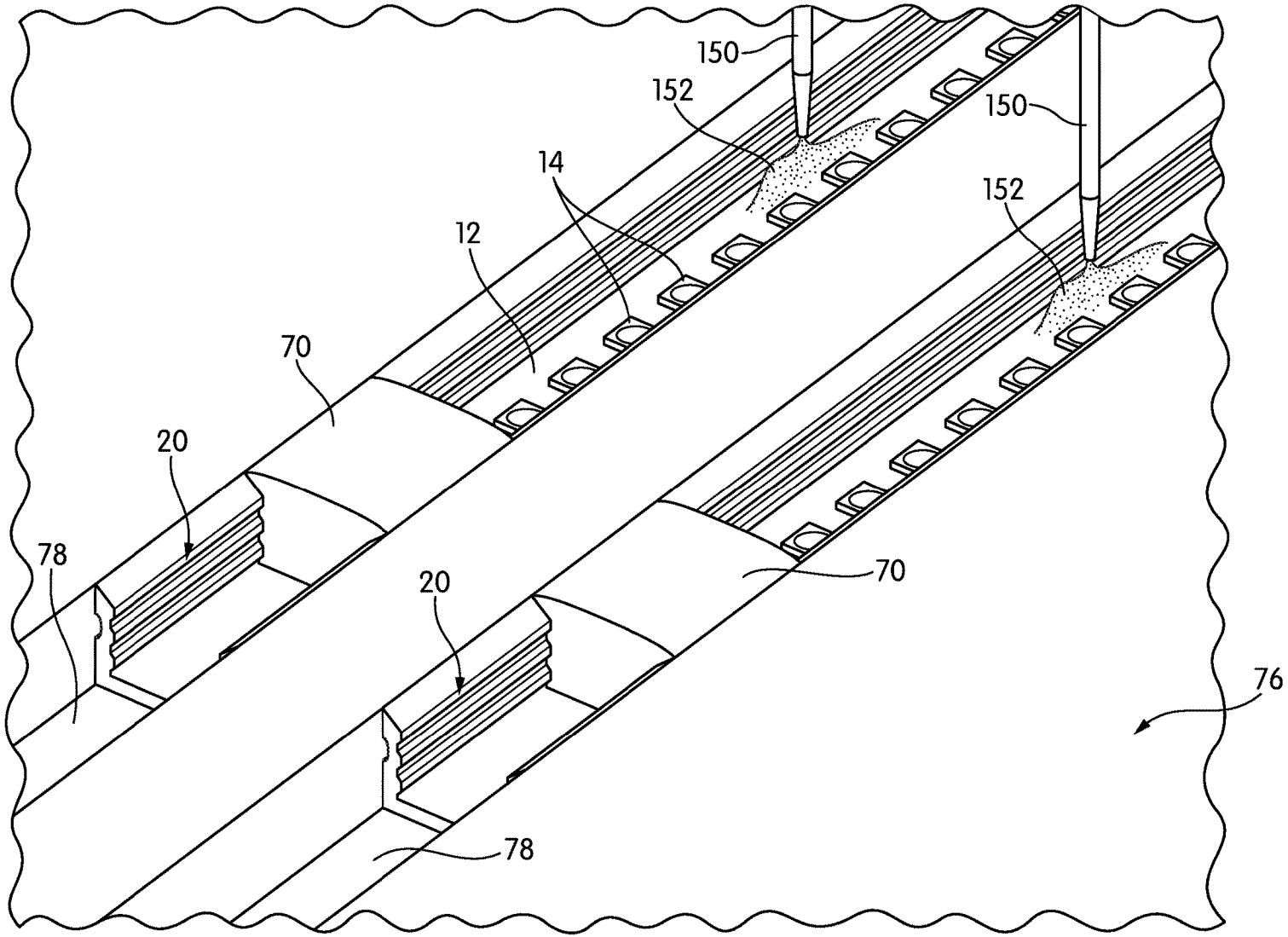
FIG. 8 is a perspective view similar to the view of FIG. 4, illustrating the channel being filled with resin.

FIG. 8 is a perspective view similar to the view of FIG. 4. Once both ends of the channel 20 are dammed with stoppers 70, 100, liquid resin material can be deposited into the channel 20 to complete the encapsulation. This is sometimes referred to as "dosing" the resin into the channel 20. In a typical setup, a nozzle or nozzles 150 deposit liquid resin 152. This may be done using the type of dispensing machine described above, or it may be done manually. In a typical setup using a dispensing machine, the nozzle or nozzles 150 are moved along the channel 20 by a translation system while metered amounts of the resin 152 are dispensed. In the illustrated embodiment, one nozzle 150 dispenses into each channel 20, but in other embodiments, two or more nozzles 150 may be used in each channel 20 for better control of deposition and flow.

The dosing process depicted in FIG. 8 may be performed in several stages. For example, a thin layer of resin 152, may be deposited and cured, and then another layer of resin 152 may be deposited and cured overtop the first layer in order to form the solid fill 22. In some cases, it may be helpful to deposit and cure a thin layer of resin 152 over the PCB 12, just enough to cover the light engines 14, before filling the channel 20 completely. Doing so may prevent air bubbles from forming within the channel 20.

The present inventors have found that the stoppers 70, 100 with their ridges 72 are surprisingly effective at containing low-viscosity resins within the channel 20. Moreover, the present inventors have found that stoppers with ridges 72 or other engaging features are less likely to leak even than comparable stoppers without such ridges 72. The complementary ridges 26 of the channel 20 are unique in that they are designed to serve no purpose in the final encapsulated product, and are simply filled in by the solid fill 22.

Once the resin 152 has cured into the solid fill 22, the stoppers 70, 100 can simply be removed from the channel 20. As was noted above, the stoppers 70, 100 are preferably made of a material that does not bond to the resin 152, either in liquid or cured form. In most cases, the stoppers 70, 100 can be used several times.

As was described briefly above, most methods for making encapsulated linear lighting 10 allow for the simultaneous manufacture of multiple strips of encapsulated linear lighting 10. The description above assumes that one strip of encapsulated linear lighting 10 will be made in each slot 78 of the carrier 76. That need not always be the case. There may be situations in which only a single strip of encapsulated linear lighting 10 is made, even though the carrier 76 has more slots. There may also be situations in which multiple, shorter strips of encapsulated linear lighting 10 are made using a single slot 78 and a single channel.

If only one strip of encapsulated linear lighting 10 is to be made using a single channel 20 placed in a single slot 78 in a carrier 76, one could set up the dosing process so that the nozzle or nozzles 150 only dispense resin into that particular channel 20, which would be dammed by stoppers 70, 100 as described above. However, if the dispensing machine is set to make multiple strips of encapsulated linear lighting 10 at once, changing it over to make a single strip of encapsulated linear lighting 10 may be difficult and time-consuming. Thus, in some circumstances, it may be desirable to place channel 20 with no PCB 12 in other slots 78 in the carrier 76 and to dam that channel 20, as appropriate, with stoppers 70, 100. The channel 20 with no PCB 12 could simply be sacrificed—thrown away—after manufacture. The above is an example of a situation in which it is more efficient to sacrifice material than it would be to re-set the dosing process.

Because they allow a channel 20 to be dammed at arbitrary points, stoppers 70, 100 may facilitate various kinds of production efficiencies, and may make it easier to optimize certain types of production runs. For example, assume that a dispensing machine is set up to make encapsulated linear lighting 10 in lengths up to 5 m (16.4 ft), and carriers 76 are arranged to make 4-5 strips of encapsulated linear lighting 10 in a single production run. Under normal circumstances, it might be inefficient to make small batches of shorter lengths of encapsulated linear lighting 10—doing so might require significant re-programming of the dispensing machine or setting up for a full-scale production run and sacrificing much of the material that is produced.

Figure 9:
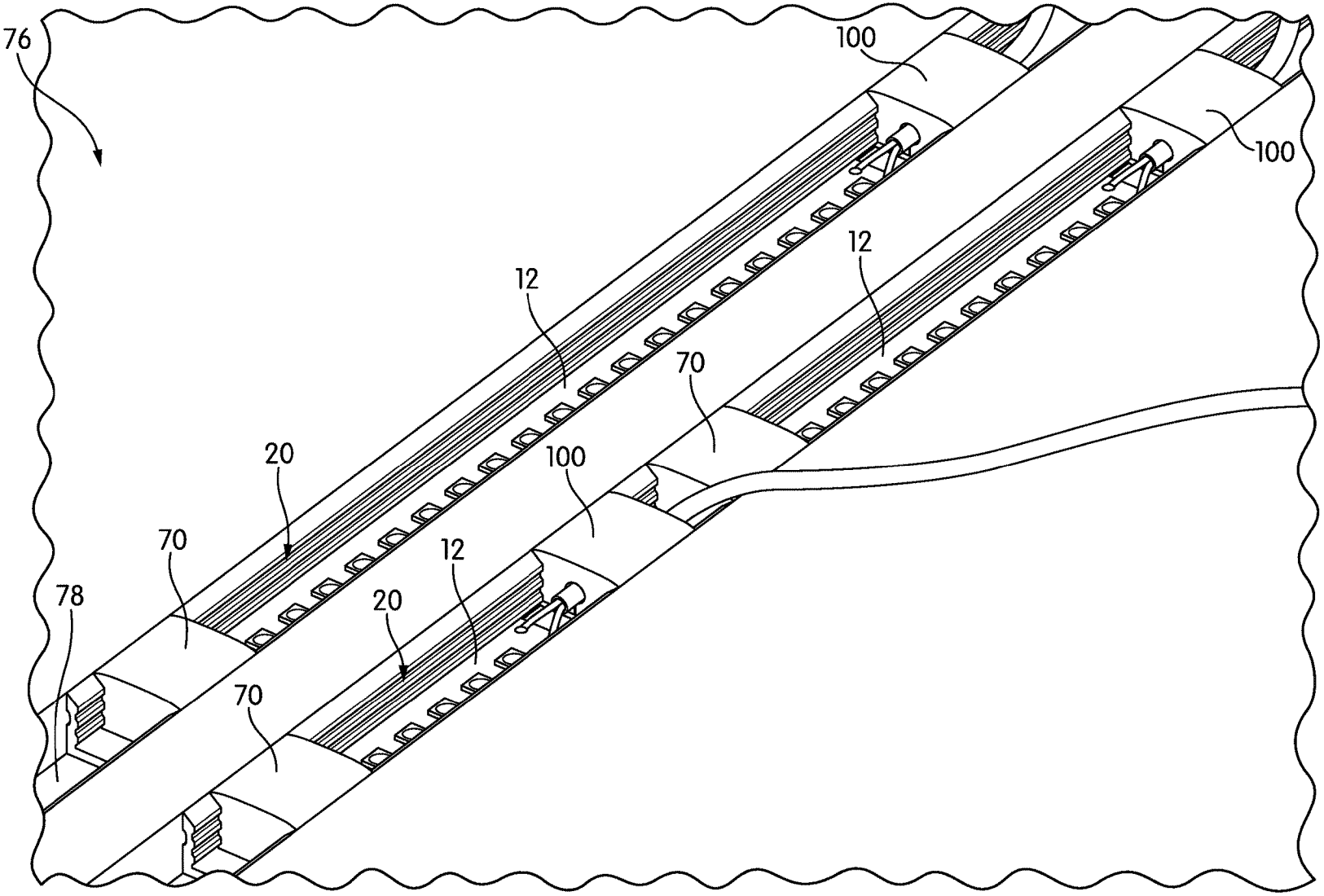
FIG. 9 is a perspective view illustrating several strips of linear lighting during a manufacturing process.

FIG. 9 is a perspective view illustrating the use of stoppers 70, 100 to reduce the inefficiencies in these situations. Specifically, FIG. 9 illustrates a carrier 76 with a number of slots 78. In each slot, a single channel 20 has a number of separate lengths of PCB 12. Multiple stoppers 70, 100 are placed along that single channel 20, each near the beginning or end of one of the lengths of PCB 12, separating the lengths of PCB 12 from one another. In this way, a single channel 20 can be used to make multiple lengths of encapsulated linear lighting 10, each one having a different length. Once the curing process is complete, the channel 20 and its fill 22 can simply be cut at desired points to form the multiple, separate lengths of linear lighting 10.

Figure 10:
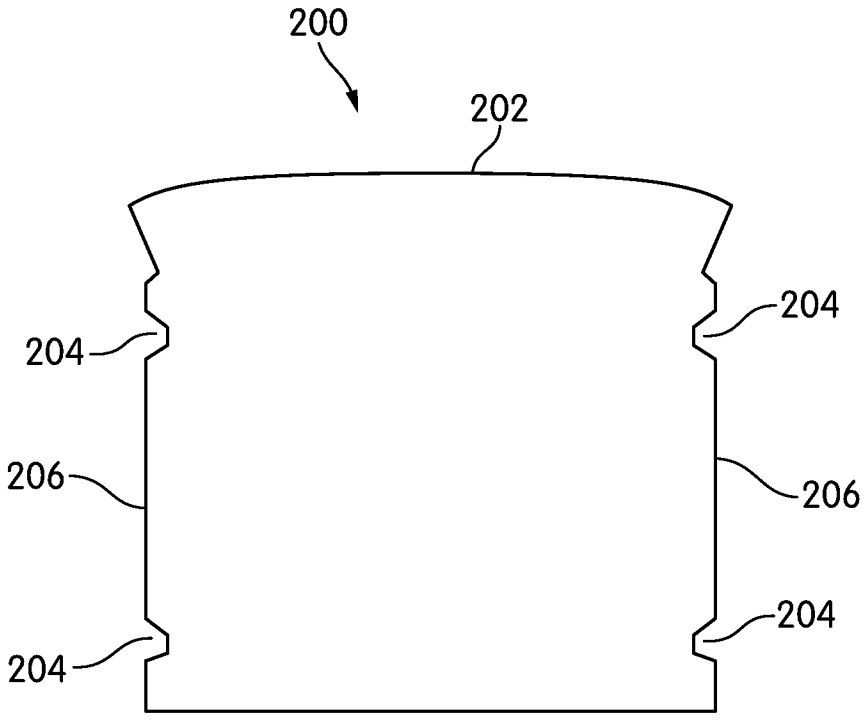
FIG. 10 is an end elevational view of a stopper according to another embodiment of the invention.

In the stoppers 70, 100, ridges 72 extend substantially the entire heights of the sides. Stoppers with other shapes and other arrangements of engaging features may be used. For example, FIG. 10 is an end-elevational view of a stopper 200 according to another embodiment of the invention. Stopper 200 has generally the same shape as the stoppers 72, 100 described above, although it has a somewhat flatter top 202 than do the stoppers 72, 100 described above. Notably, though, instead of an undulating series of ridges 72, the stopper 200 has two individual grooves 204 on each side. The two individual grooves 204 are spaced apart vertically along the sidewalls 206, with some distance and a generally straight section of sidewall 206 between them. In this case, one groove 204 is near the bottom of the sidewall 206 and one groove 204 is near the top of the sidewall 206 on each side. As may be evident from the above description, channel would be made with complementary features, and a similar stopper with an appropriate opening for power cable 16 would be made using the techniques described above.

The number of individual engaging features needed on each sidewall of a stopper 70, 100, 200, as well as their depth, spacing, and other attributes, will vary based on a number of factors, including the height, width, and resultant volume of the channel 20. Smaller channels 20 may require fewer engaging features in order to make a seal with a stopper 70, 100, 200. Engaging features, such as ridges 72 or grooves 204, may be more helpful toward the bottom of the channel 20, where hydrostatic pressures are likely to be larger.

Other relevant factors may include the materials of which the stoppers 70, 100, 200 and channel 20 are made. Because the linear lighting 10 is subject to thermal cycling in order to cure the resin 152 into the solid covering 22, it is helpful if the stoppers 70, 100, 200 and the channel 20 have similar coefficients of thermal expansion. If, for example, the channel 20 expands much more quickly than its stoppers 70, 100, it is possible that gaps could be created that could allow uncured resin 152 to leak. However, it is perfectly possible to use a channel 20 with a relatively low coefficient of thermal expansion, e.g., a channel 20 made of a metal, with a polymeric stopper 70, 100, 200 provided that the channel 20 is capable of bearing the resultant thermal expansion strain.

Figure 11:
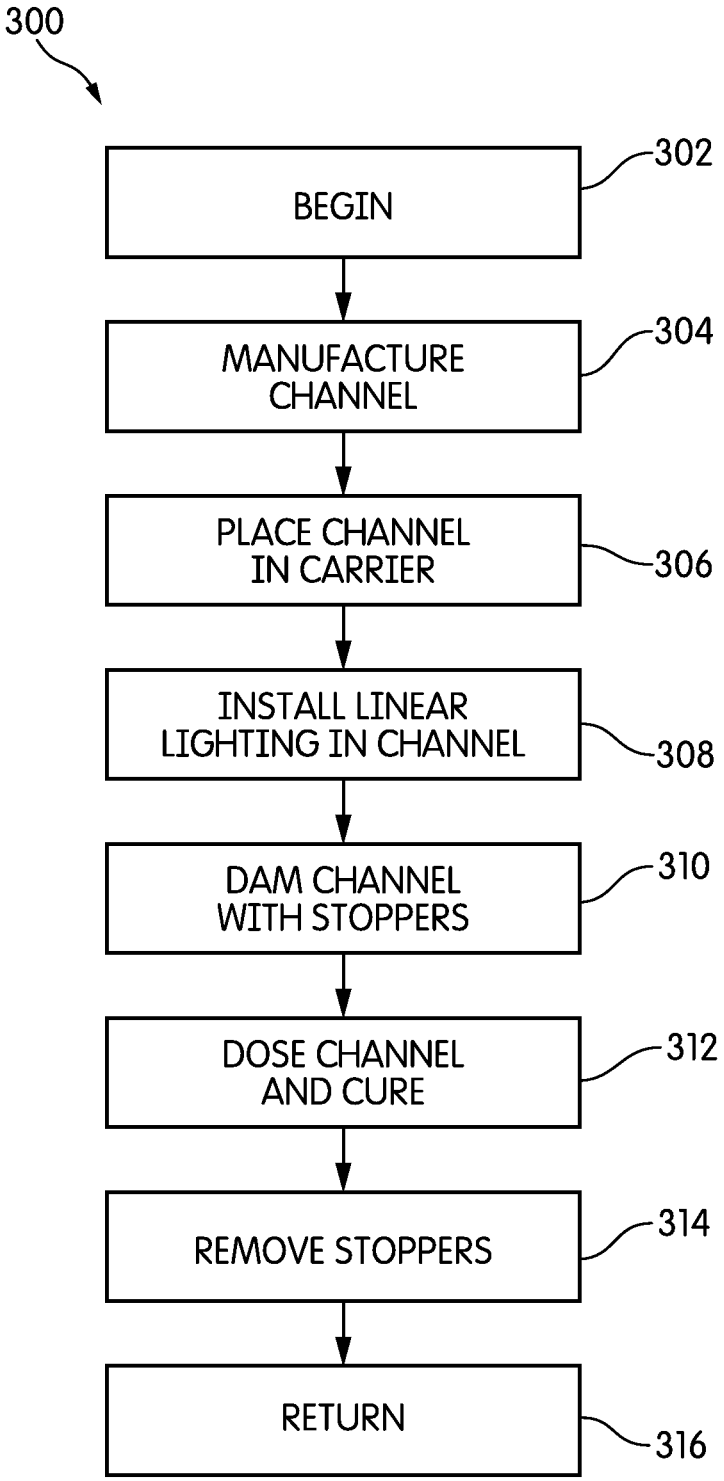
FIG. 11 is a flow diagram illustrating a method of using stoppers.

FIG. 11 is a flow diagram that summarizes the description above and describes the use of stoppers 70, 100, 200 as a method, which is generally indicated at 300. Method 300 begins at 302 and continues with task 304. In task 304, stoppers 70, 100, 200 are manufactured with the appropriate engaging features 72, 204 for the channel 20 in which they are to be used. This may involve casting in a master tool 50, casting in the channel 20 itself, or extruding, to name a few possible options.

Tasks 304 of method 300 may not need to be performed in every iteration of method 300. Once stoppers 70, 100, 200 have been created, they may be used with corresponding channel several times, unless they show signs of damage or wear. However, the nature of the stoppers 70, 100, 200 makes them readily mass-producible and disposable, if disposal becomes necessary.

Tasks 306-314 of method 300 are the tasks that would be performed in every production run. Prior to beginning task 306, it may be helpful to warm the carrier 76, the channel 20, the PCB 12 and the stoppers 70, 100 to about the same temperature, so as to avoid differential thermal expansions and the attendant stresses and length disparities. Method 300 continues with task 306, in which channel 20 is seated in a slot 78 within a carrier 76. This would typically be done manually, although a roller or another such tool may be used in some cases.

Method 300 continues with task 308, in which the PCB 12 is installed in the channel 20. Assuming the PCB 12 has pressure-sensitive adhesive and a release layer on its reverse, this would typically be done by removing the release layer and pressing the adhesive into the channel 20. A roller could be used, in which case the roller would usually be machined to a profile that does not apply direct pressure to the light engines 14 as the roller passes over them.

Once the PCB 12 has been laid in the channel 20, method 300 continues with task 310, and the channel 20 is dammed with stoppers 70, 100, 200 as described above. Depending on the particular situation, one pair of stoppers 70, 100 could be used per strip of channel 20, or if multiple, shorter lengths of encapsulated linear lighting 10 are desired, multiple pairs of stoppers 70, 100 could be used along a single strip of channel 20.

Once the channel 20 is dammed with stoppers 70, 100 in task 310, method 310 continues with task 312 and the channel 20 is dosed with resin 152. As was described above, this may be done in several steps, and individual layers of resin may be cured before adding more. Combinations of transparent and translucent resins may be used.

After the final layers of resin are laid down and cured, method 300 continues with task 314, the stoppers 70, 100 are removed, and any necessary finishing steps are completed. Once this is done, method 300 concludes and returns at task 316.

While the invention has been described with respect to certain embodiments, the description is intended to be exemplary, rather than limiting. Modifications and changes may be made within the scope of the invention, which is set forth in the following claims.

What is claimed is:

1. A method, comprising:

placing multiple strips of linear lighting in a channel, the channel having interior engaging features, the multiple strips of linear lighting being spaced from one another along the channel;

damming the channel with stoppers placed at each end of each of the multiple strips of linear lighting, the stoppers having complementary engaging features that are adapted to engage the interior engaging features of the channel;

dosing the dammed channel with a polymer resin to encapsulate the multiple strips of linear lighting;

causing or allowing the polymer resin to cure; and removing the at least two stoppers from the channel.

2. The method of claim 1, further comprising separating the multiple encapsulated strips of linear lighting.

3. The method of claim 1, wherein one end of each of the multiple strips of linear lighting is connected to a power cord and ones of the stoppers placed proximate to cord-ends of the multiple strips of linear lighting have openings that allow the power cords to pass through.

4. The method of claim 3, wherein the interior engaging features and the complementary engaging features comprise grooves or ridges.

5. The method of claim 3, further comprising forming the at least two stoppers by:

casting a stopper resin in the channel or in a master tool having the shape of the channel; and causing or allowing the stopper resin to cure; and removing the cured stopper resin from the channel.

6. The method of claim 5, further comprising:

dividing the cured stopper resin to form the at least two stoppers.

7. The method of claim 3, wherein the channel is cast from the same type of polymer as the polymer resin.

8. The method of claim 3, wherein the channel is extruded from a channel resin compatible with the polymer resin.

9. The method of claim 3, wherein the channel is made of a metal.

10. The method of claim 1, wherein the multiple strips of linear lighting each have a flexible PCB.

11. The method of claim 1, wherein the channel comprises a polymer.

12. The method of claim 11, wherein the channel is flexible.

13. The method of claim 12, wherein the cured polymer resin is flexible.

14. The method of claim 11, wherein the channel comprises polyurethane or silicone.

15. The method of claim 11, wherein the channel is substantially rigid.

16. The method of claim 1, wherein the stoppers comprise a material that will not bond with the channel or with the polymer resin.

17. The method of claim 16, wherein the stoppers comprise a silicone polymer.

18. The method of claim 17, wherein the polymer resin comprises a polyurethane resin.

19. The method of claim 11, further comprising, prior to said placing, installing the channel in a carrier.

* * * * *